US006438988B1

(12) United States Patent
Paskey

(10) Patent No.: US 6,438,988 B1
(45) Date of Patent: Aug. 27, 2002

(54) KIT TO INCREASE REFRIGERATOR ICE PRODUCT

(76) Inventor: Dennis J. Paskey, 3000 S. 105th St., Fort Smith, AR (US) 72903

( * ) Notice: Subject to any disclaimer, the term of this patent is extended or adjusted under 35 U.S.C. 154(b) by 0 days.

(21) Appl. No.: 09/984,457

(22) Filed: Oct. 30, 2001

(51) Int. Cl.[7] ..... F25C 1/00
(52) U.S. Cl. ..... 62/353; 62/419
(58) Field of Search ..... 62/353, 351, 344, 62/419, 426

(56) References Cited

U.S. PATENT DOCUMENTS

| | | | | | |
|---|---|---|---|---|---|
| 3,908,391 | A | * | 9/1975 | Wulke et al. | 62/353 |
| 4,142,378 | A | * | 3/1979 | Bright et al. | 62/353 |
| 4,649,717 | A | | 3/1987 | Tate, Jr. et al. | |
| 4,799,362 | A | | 1/1989 | Chestnut | |
| 4,852,359 | A | | 8/1989 | Mazzotti | |
| RE34,174 | E | * | 2/1993 | Brown et al. | 62/351 |
| 5,182,916 | A | * | 2/1993 | Oike et al. | 62/353 |
| 5,212,955 | A | * | 5/1993 | Hogan | 62/353 |
| 5,245,841 | A | * | 9/1993 | Paul et al. | 62/344 |
| 5,317,883 | A | | 6/1994 | Newman | |
| 5,319,937 | A | * | 6/1994 | Fritsch et al. | 62/426 |
| 5,375,432 | A | * | 12/1994 | Cur | 62/351 |
| 5,709,104 | A | | 1/1998 | Howcroft | |
| 5,713,215 | A | | 2/1998 | Choi | |
| 5,768,899 | A | * | 6/1998 | Lee et al. | 62/353 |
| 5,889,243 | A | * | 3/1999 | Edwards et al. | 200/35 R |

* cited by examiner

*Primary Examiner*—William E. Tapolcai
*Assistant Examiner*—Mohammad M. Ali
(74) *Attorney, Agent, or Firm*—Richard C. Litman

(57) ABSTRACT

A kit which retroactively fits an ice-maker to increase the rate of production of ice. The kit comprises a bracket, a fan and fan motor, and a power source for the fan motor. The fan motor and fan is positioned above the ice maker within the freezer compartment and blows air downward, directly over the ice production tray which contains water. The circulation of a stream of cold air causes the temperature in the vicinity of the water to drop more rapidly than it would without the fan-produced circulation of cold air. Also, cooling is hastened by the induced evaporation of the water by the cold air stream. When the water is frozen, the ice maker ejects the ice into an ice container. The bracket provides support for the fan motor, which is secured to the bracket with four machine screws.

18 Claims, 8 Drawing Sheets

KIT TO INCREASE REFRIGERATOR ICE PRODUCT

BACKGROUND OF THE INVENTION

1. Field of the Invention

The present invention relates to ice making machines. More particularly, the present invention relates to kits designed to retroactively fit an ice-maker to accelerate ice making.

2. Description of the Related Art

The use of automatic ice-makers in refrigerator freezers is well known. They are limited, however, in the rate of making of ice cubes. It would be desirable to provide a kit which may be installed on existing ice makers which would substantially increase the rate of freezing and thus the production of ice cubes.

A presently marketed ice-maker known as the Acceler-Ice® system sold with new Kenmore Elite® product line refrigerator freezers (image not available) and made by WHIRLPOOL CORPORATION mounts on the front of the ice maker module which powers an AC blower motor. The motor is internal to the Ecceler-Ice® housing. Air is blown along the bottom of the aluminum die-cast ice tray. Air is moved in a direction parallel to the ice tray and is blown from the front of the tray to the back. The aluminum die-cast tray in this design creates a thermal and physical barrier. The air must cool the tray, which, in turn, must cool the water. The inventive kit blows cold air downward, perpendicular to and relatively uniformly over the ice tray, directly on the water itself, causing the water to freeze at a faster rate due to more rapid heat transfer and increased evaporation.

U.S. Pat. No. 4,852,359, issued Aug. 1, 1989, to Mazzotti describes an ice-maker for use in a refrigerator freezer compartment and having an ice-forming tray supported on a carrier body. The carrier body has a housing with an air-circulating fan directing a flow of cold air from the lower part of the freezer ha compartment over one end of the ice tray, both above and below, during the ice-making process. The present ice-making kit directs a cold air downward directly over the ice tray of the automatic ice-maker upon which it is installed, thus uniformly increasing heat transfer and water evaporation and thereby dramatically increasing the rate of freezing relatively uniformly over the length of the tray. The '359 patent merely directs cold air over the ice tray at one end and would not be effective in inducing a uniform high rate of heat transfer over the entire tray and would not induce substantial water evaporation uniformly over the tray.

U.S. Pat. No. 5,317,883, issued Jun. 7, 1994, to Newman describes an apparatus and method for increasing the cooling rate of an item and its contents within a refrigeration system. The cooled item is placed in a housing that includes a motor driven fan the apparatus is placed in a refrigeration system and the motor driven fan moves cold air through the housing. The '883 patent moves cold air over the bodies of the sample containers rather than over an open top( the test tubes shown appear to be sealed by a cork or cap), thus, no cold air is directed to the open surface of a sample and no evaporation is induced in the sample to accelerate freezing, the principle employed by the present invention.

U.S. Pat. No. 5,713,215, issued Feb. 3, 1998, to Choi describes a refrigerator having a quick-freezing facility. A blowing fan and an evaporator are arranged so the blowing fan forces air through the evaporator into the freezing compartment. The '215 patent does not provide a system for blowing cold air downward, directly over an ice tray for increasing heat transfer and for inducing evaporative cooling of water to accelerate ice formation as in the present invention.

U.S. Pat. No. 4,649,717, issued Mar. 17, 1987 to Tate, Jr. et al. describes an ice maker assembly useful with the kit of the present invention.

U.S. Pat. No. 4,799,362, issued Jan. 24, 1989, to Chestnut describes a modular ice maker having accommodation for testing which is useful with one embodiment of the present invention.

U.S. Pat. No. 5,709,104, issued Jan. 20, 1998, to Howcroft describes a cooling device for use in a chamber such as an ice chest which employs a dry ice chamber having a fan operated to induce flow of air through the dry ice chamber responsive to a thermostat. The '104 patent does not provide a system for directing cold air downward, directly over and ice cube tray, increasing the cooling rate and inducing evaporative cooling of water to accelerate ice formation as in the present invention.

None of the above inventions and patents, taken either singularly or in combination, is seen to describe the instant invention as claimed. Thus a kit to increase refrigerator ice production solving the aforementioned problems is desired.

SUMMARY OF THE INVENTION

The present invention is a kit designed to retroactively fit an ice-maker to increase the rate of production of ice. The kit comprises a bracket, a fan and fan motor, and a power source for the fan motor. The fan motor and fan is positioned above the ice maker within the freezer compartment and blows air downward, directly over the ice production tray which contains water. The circulation of a stream of cold air causes the temperature in the vicinity of the water to drop more rapidly than it would without the fan-produced circulation of cold air. Also, cooling is hastened by the induced evaporation of the water by the cold air stream. When the water is frozen, the ice maker ejects the ice into an ice container. The bracket provides support for the fan motor, which is secured to the bracket with four machine screws.

The bracket is installed by loosening the two ice-maker mounting screws, sliding the bracket between the ice maker and the liner wall of the refrigerator, and tightening the two screws. Where the ice-maker is installed by clips, the ice-maker may be removed from the clips, the clips may be removed from the liner wall, the bracket put in place, and the clips reattached to the liner wall through rectangular cutouts in the bracket, and the ice-maker reattached to the clips. The outer exposed edge of the bracket may be bent downward to increase the strength of the bracket, to absorb vibrations from the motor, and to aid in the direction of air flow perpendicular to the top of the ice maker tray.

For compact style ice makers, the electrical AC fan motor may be powered by an AC source within the refrigerator. For example, a connection may be made between the ice maker power connector and its mating connector in the refrigerator. This configuration for providing power is the preferred embodiment of the invention On modular style ice-makers, a similar AC connection may be made as above, or, alternatively, a 115-V AC power source can be obtained by connecting to the test ports on the ice maker.

For modular style ice makers, an alternate power sources may be the ice maker module, itself. The ice maker module has test ports, used by service technicians to run electrical diagnostic tests on the ice-maker. A 115-V AC power source can be obtained by tying into the "t" and "h" test ports on the end drive. In such an embodiment, the cover assembly transfers the power from the ice maker module to the fan motor by way of a wire harness. The cover assembly consists of a front cover, a positioning plate, standoff mounting screws and nuts, brass probes, and insulated electrical wire. The front cover houses all of the above components and replaces the front cover that originally came with the ice-maker. As the cover assembly slides over the front face of the ice maker module, the two brass probes then slide into the proper test ports and make electrical contact within the ice-maker drive module. The cover has tabs on the top and bottom that snap into the ice-maker drive module, securing it in place. The brass probes are fixed in position through the positioning plate, which is secured to the front cover by three standoff screws and nuts. The standoff screws are used to space the positioning plate from the front cover to provide clearance for the insulated wires, which are soldered to the base of the brass probes. The other ends of the wires feed out the side of the front cover and are attached to the fan motor via terminals, thereby completing the electrical circuit.

A grill and a cage guard are provided on the upper and lower sides respectively, of the motor facing to prevent a user from contacting the fan blades.

Accordingly, it is a principal object of the invention to provide a kit which may be retrofitted on an ice-maker of the type commonly provided in a home refrigerator-freezer which accelerates the production of ice.

It is another object of the invention to provide a kit as above which provides substantial air movement, at a close proximity to the freezing water.

It is a further object of the invention to provide a kit as above which provides for blowing air perpendicularly to the freezing water surface.

Still another object of the invention is to provide a kit as above which provides for blowing air directly downward on the water surface rather than on an ice-maker mold.

It is yet another object of the invention to provide a kit as above which may be readily installed by a service technician or home owner by following simple directions.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
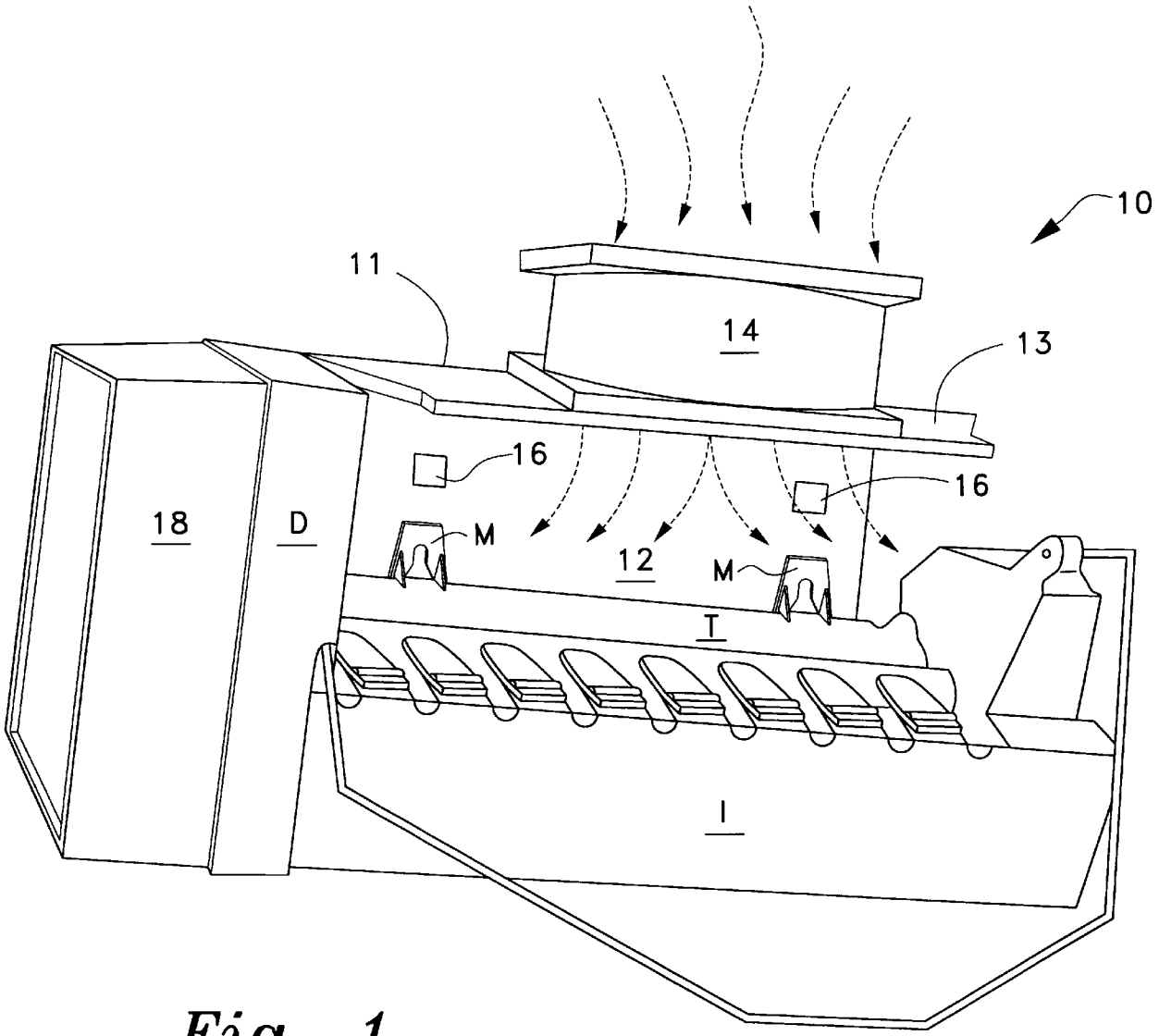
FIG. 1 is an environmental, perspective view of a kit to increase refrigerator ice produced as installed on an ice-maker according to the present invention.

The present invention is a kit designed to retroactively fit an ice-maker to increase the rate of production of ice. The kit comprises a bracket, a fan and fan motor, and a power source for the fan motor. The fan motor and fan is positioned above the ice maker within the freezer compartment and blows air downward, directly over the ice production tray which contains water. The circulation of a stream of cold air causes the temperature in the vicinity of the water to drop more rapidly than it would without the fan-produced circulation of cold air. Also, cooling is hastened by the induced evaporation of the water by the cold air stream. When the water is frozen, the ice maker ejects the ice into an ice container. The bracket provides support for the fan motor, which is secured to the bracket with four machine screws.

The bracket is installed by loosening the two ice-maker mounting screws, sliding the bracket between the ice maker and the liner wall of the refrigerator, and tightening the two screws. Where the ice-maker is installed by clips, the ice-maker may be removed from the clips, the clips may be removed from the liner wall, the bracket put in place, and the clips reattached to the liner wall through rectangular cutouts in the bracket, and the ice-maker reattached to the clips. The outer exposed edge of the bracket may be bent downward to increase the strength of the bracket, to absorb vibrations from the motor, and to aid in the direction of air flow perpendicular to the top of the ice maker tray.

For compact style ice makers, the electrical AC fan motor may be powered by an AC source within the refrigerator. For example, a connection may be made between the ice maker power connector and its mating connector in the refrigerator. This configuration for providing power is the preferred embodiment of the invention On modular style ice-makers, a similar AC connection may be made as above, or, alternatively, a 115-V AC power source can be obtained by connecting to the test ports on the ice maker.

For modular style ice makers, an alternate power sources may be the ice maker module, itself. The ice maker module has test ports, used by service technicians to run electrical diagnostic tests on the ice-maker. A 115-V AC power source can be obtained by tying into the "t" and "h" test ports on the end drive. In such an embodiment, the cover assembly transfers the power from the ice maker module to the fan motor by way of a wire harness. The cover assembly consists of a front cover, a positioning plate, standoff mounting screws and nuts, brass probes, and insulated electrical wire. The front cover houses all of the above components and replaces the front cover that originally came with the ice-maker. As the cover assembly slides over the front face of the ice maker module, the two brass probes then slide into the proper test ports and make electrical contact within the ice-maker drive module. The cover has tabs on the top and bottom that snap into the ice-maker drive module, securing it in place. The brass probes are fixed in position through the positioning plate, which is secured to the front cover by three standoff screws and nuts. The standoff screws are used to space the positioning plate from the front cover to provide clearance for the insulated wires, which are soldered to the base of the brass probes. The other ends of the wires feed out the side of the front cover and are attached to the fan motor via terminals, thereby completing the electrical circuit.

A grill and a cage guard are provided on the upper and lower sides respectively, of the motor facing to prevent a user from contacting the fan blades.

Figure 2:
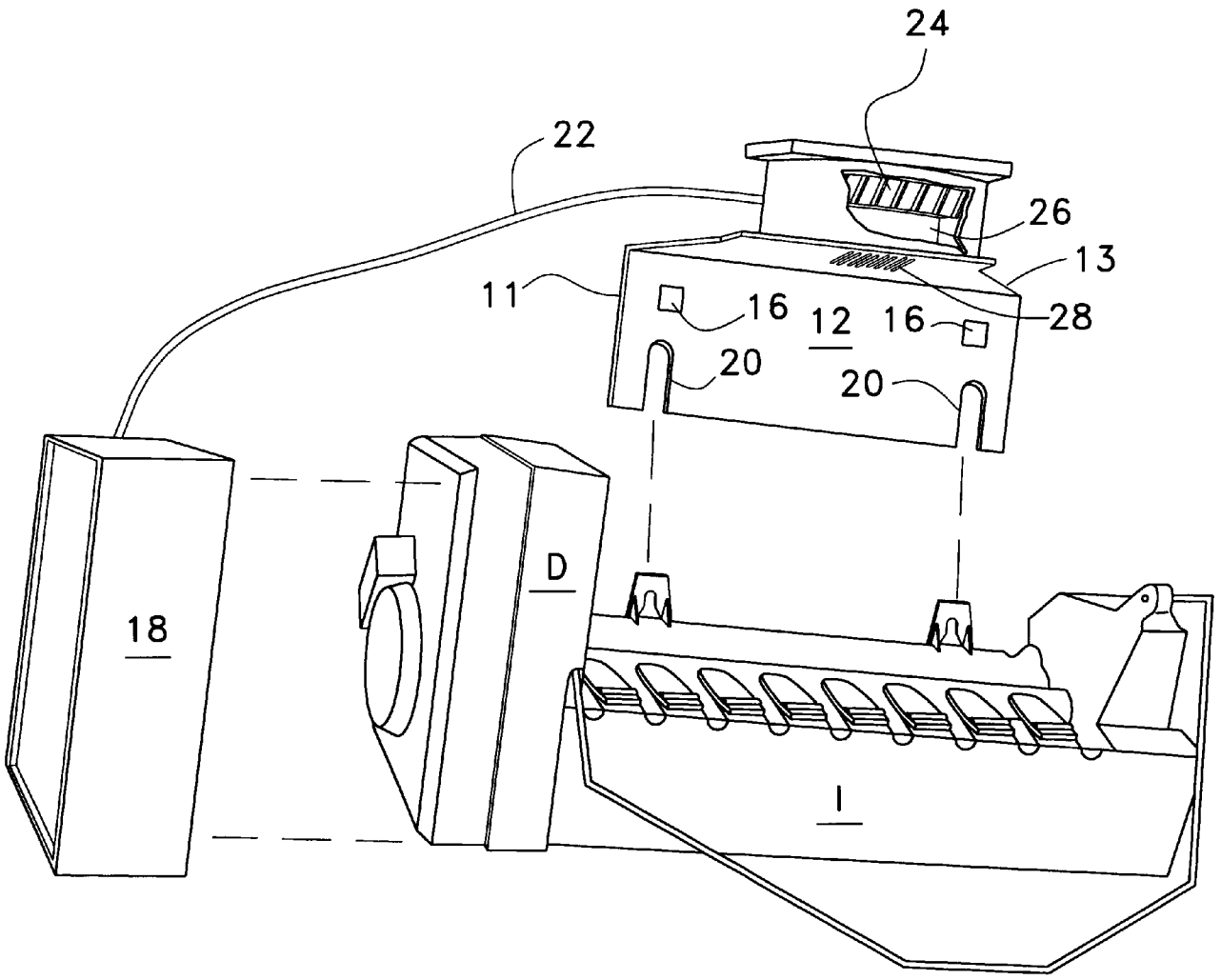
FIG. 2 is a fragmented, exploded view of the kit installation of FIG. 1 showing an electrical lead to the fan.

Referring to FIGS. 1 and 2, there is shown a perspective view of an ice-maker with the inventive kit as installed and an exploded perspective view thereof, respectively. Ice production accelerator kit 10 includes an angle bracket 11 having a vertical mounting wall 12 and a horizontal support wall 13 which supports a vertically oriented fan 14. Vertical mounting wall 12 includes clip mount access squares 16.

Vertical mounting wall 12 includes bracket mounting grooves 20 for sliding over mounting screws(not shown) when loosened relative to ice-maker mounts M. Bracket 11 is then secured by tightening the mounting screws over the mounts M and vertical mounting wall 12 of angle bracket 11 against the refrigerator wall(not shown). The sides of horizontal support wall 13 of bracket 11 angle inwards to provide easy access to the ice-maker mounting screws(not shown) during installation of the kit.

Figure 5:
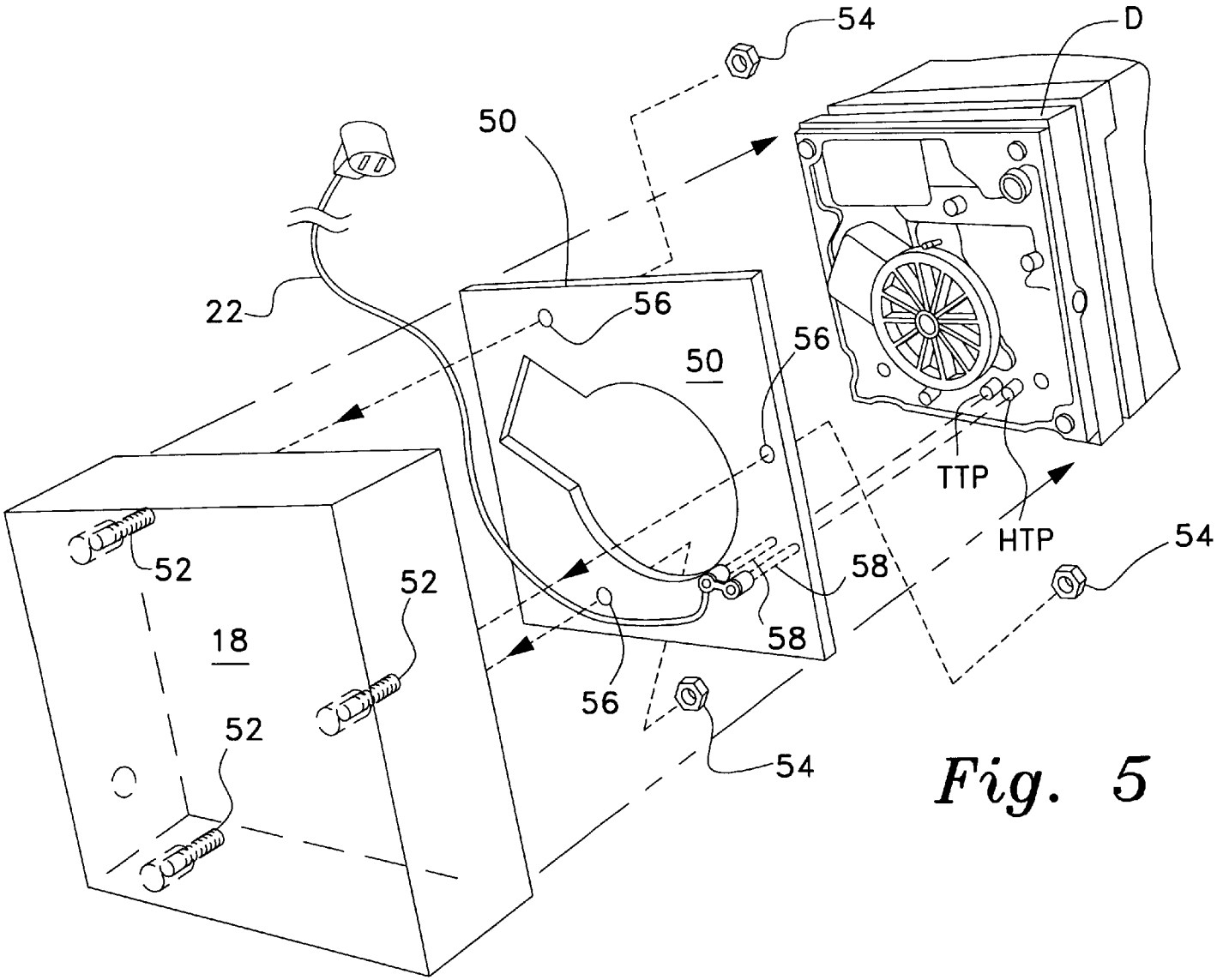
FIG. 5 is an exploded view of the substitute end housing of one embodiment of the inventive kit as it relates to the ice-maker drive.

In an alternative embodiment of the invention limited to modular ice-makers, two-wire harness 22 is connected with kit end housing 18 and supplies electrical power to fan 14 (see FIG. 5). Two wire harness 22 is connected with end drive D within kit end housing 18 in a manner so as to derive electrical power therefrom.

Horizontal support wall 13 has a grill 28 beneath the fan 14 to allow flow of air downward over ice-maker I while protecting a user from injury. Fan 14 includes an impeller 24 turned by an electric motor 26 so located in fan 14 as to move cold air downward through grill 28 of horizontal support wall 13 toward horizontal exposed ice tray T if ice-maker I. Horizontal support wall 13 is located in close proximity to said ice-tray T while being spaced from ice-tray T such as to not interfere with the rotating fingers of ice-maker I for removal of frozen ice cubes from the tray T.

Figure 3A:
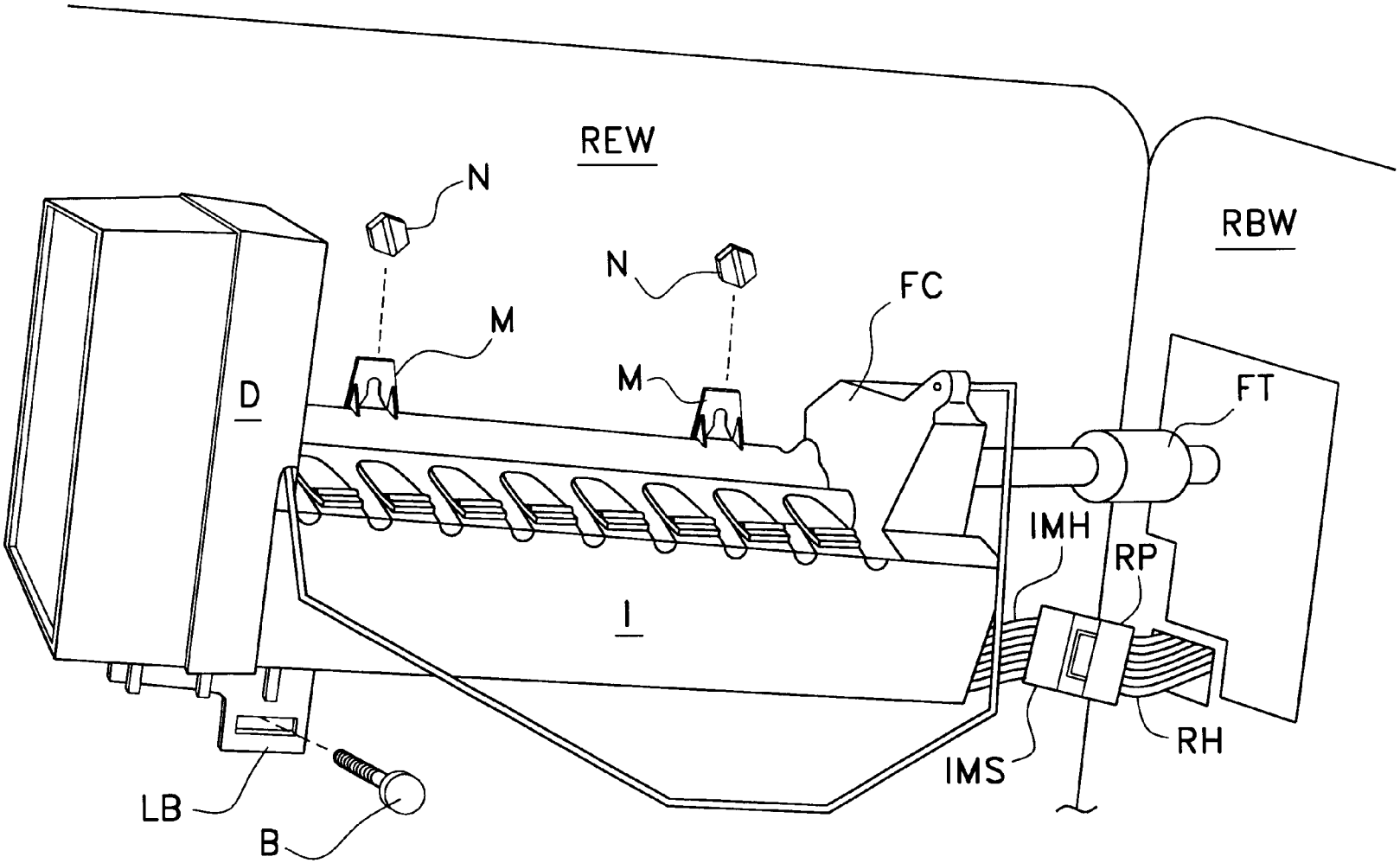
FIG. 3A is an environmental perspective view of an ice-maker which is mounted on a refrigerator wall by mounting screws acting on mounts on the ice-maker and showing the electrical connection to the ice-maker.
Figure 3B:
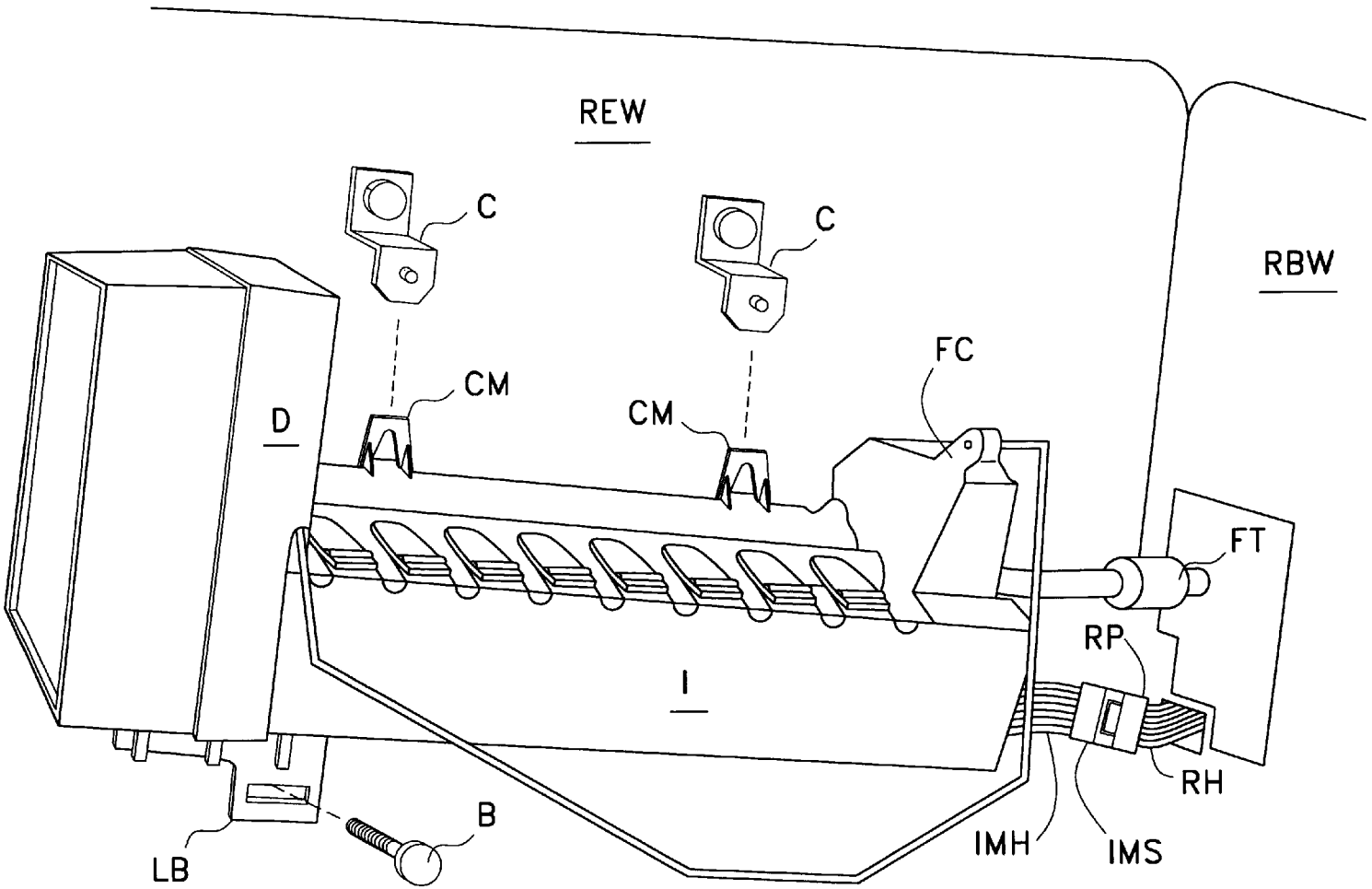
FIG. 3B is similar to FIG. 3 where the ice-maker is mounted by clips to the refrigerator wall.

Referring to FIGS. 3A and 3B, there are shown two similar ice-makers I, without the inventive kit installed, attached to the refrigerator end wall REW and the refrigerator back wall RBW by alternative means, i.e., nut head screws N and mounts M, and clips C and clip mounts CM, respectively. Ice makers I are each additionally supported by lower bracket LB and bolt B which screws into refrigerator end wall REW. Water is supplied through refrigerator back wall RBW by fill tube FT leading to fill cup FC which supplies water to either ice-maker I, once frozen cubes are ejected. Ice-maker harness IMH is connected with refrigerator harness RH by means of inter-fitting ice-maker socket IMS and refrigerator power plug RP, refrigerator harness RH being connected to a source of electric power.

Figure 4:
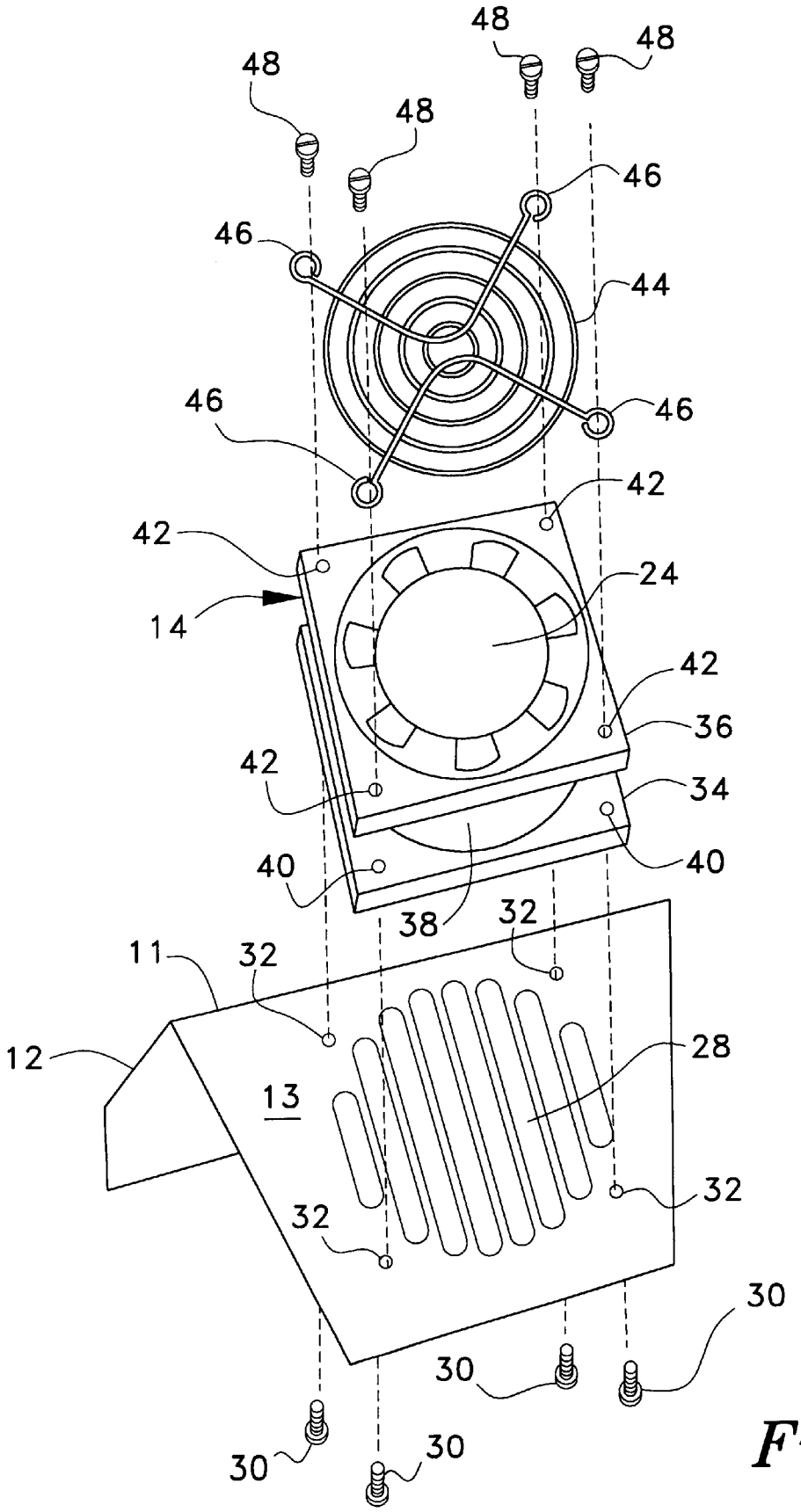
FIG. 4 is an exploded view of the bracket and fan of the kit of the present invention.

Referring to FIG. 4, there is shown an exploded view in perspective of angle bracket 11, fan 14, and fan safety cage 44. Electrical wiring for the fan motor is not shown(see FIG. 5 for alternative modular unit fan motor wiring harness and FIG. 4 for both modular and compact unit fan motor wiring harness). Angle bracket 11 has vertical mounting wall 12 and horizontal support wall 13 for supporting fan 14.

Horizontal support wall 13 has a bracket grill 28 so positioned as to allow flow of air from fan 14 to the ice-maker tray. Bracket fan screws 30 are inserted through screw holes 32 for mounting fan 14(for some applications only two screws 30 and two snap-in plastic fasteners are employed). The screws 30 have serrated heads which provide a ground path between the motor and the bracket. Fan 14 includes fan lower mount plate 34 and fan upper mount plate 36 separated by fan cylindrical duct 38.

Fan 14 is mounted by screwing bracket fan screws 30 into bracket fan screw receivers 40 located at the corners of fan lower mount plate 34. Fan safety cage fan screw receivers 42 are located at the corners of fan upper mount plate 36 whereby fan safety cage 44 may be mounted to upper mount plate 36 by means of safety cage screw holes 46 through which safety cage fan screws 48 are inserted and screwed into screw receivers 42. For some applications only two safety cage fan screws 48 and two snap-in plastic fasteners 49 are employed(see FIG. 7).

Referring to FIG. 5, there is shown an exploded perspective view of the kit end housing of the alternative embodiment of the invention as it relates to ice-maker drive D of a modular ice-maker. Connector plate 50 is fitted into kit end housing 18 by means of spacer screws 52 inserted through connector plate 50 and secured by spacer screw nuts 54 at spacer screw bores 56. Connector plate 50 bears two electrical probes 58 which fit into "t" test port TTP and "h" test port HTP of ice-maker end drive D. Connector plate 50 is so configured as to fit over protruding parts of drive D when end housing 18 is snapped onto drive D by tabs (not shown). Electrical probes 58 are also inserted into their respective test ports TTP and HTP, making electrical connections therewith. The test ports form an electrical circuit with probes 58 and thereby to a two-wire wiring harness 22 to fan motor 26(see FIG. 2), thereby supplying electric power to drive the fan motor.

Figure 6A:
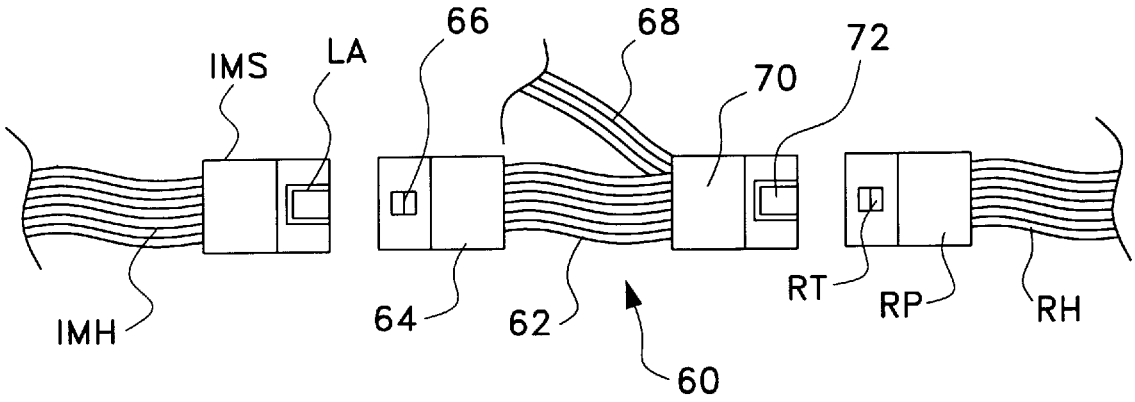
FIG. 6A is a diagrammatic exploded view of the kit electrical harness as inserted between the refrigerator power cord and an ice-maker.

Referring to FIG. 6A, there is shown a harness assembly of the preferred embodiment of the invention using locking tab type connectors such as found on Whirlpool® refrigerators. They are disconnected by lifting the locking arm on the ice-maker connector over the tab on the refrigerator connector and pulling the connectors apart. Kit harness 60 includes kit harness connecting wires 62 connecting to kit harness ice-maker plug 64 having plug tab 66. Kit harness connecting wires 68 are connected at a pig-tail(not shown) of kit harness refrigerator socket 70 which is also connected with connecting wires 62 at the ends opposite kit harness ice-maker plug 64. Socket 70 includes locking arm 72. Kit harness 60 is connected to ice-maker harness IMH by means of plug tab 66 of kit harness plug 64 locking into ice-maker socket IMS having locking arm LA. Kit harness 60 is connected to refrigerator harness RH by means of kit harness refrigerator socket 70 having locking arm 72 locking into refrigerator plug RP having refrigerator plug tab RT.

Figure 6B:
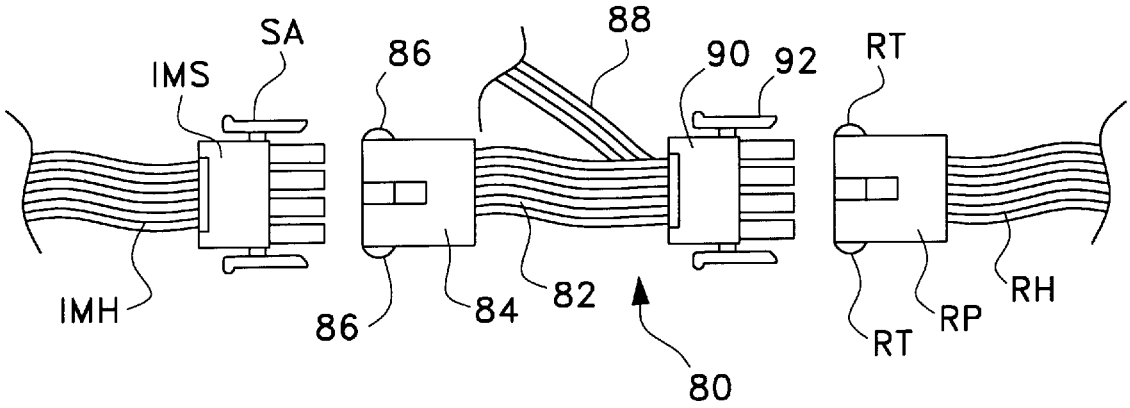
FIG. 6B is a view similar to that of FIG. 6A showing an alternative kit electrical harness employing a different plug configuration.

Referring to FIG. 6B, there is shown a harness assembly similar to that of FIG. 6A but using squeeze tab connectors such as found on Amana®, Maytag®, and Frigidaire® refrigerators and having arms acting on tabs rather than locking arms as in FIG. 6A. They are disconnected by squeezing the two opposed tabs on the ice-maker connector together and pulling the connectors apart. Kit harness 80 includes kit harness connecting wires 82 connecting to kit harness ice-maker plug 84 having plug tabs 86. Kit harness connecting wires 88 are connected at a pig-tail(not shown) of kit harness refrigerator socket 90 which is also connected with connecting wires 82 at the ends opposite kit harness ice-maker plug 84. Socket 90 includes squeeze arm 92. Kit harness 80 is connected to ice-maker harness IMH by means of opposing plug tabs 86 of kit harness plug 84 locking into ice-maker socket IMS having squeeze arms SA. Kit harness 80 is connected to refrigerator harness RH by means of kit harness refrigerator socket 90 having squeeze arms 92 locking into refrigerator plug RP having opposed refrigerator plug tabs RT.

Figure 7:
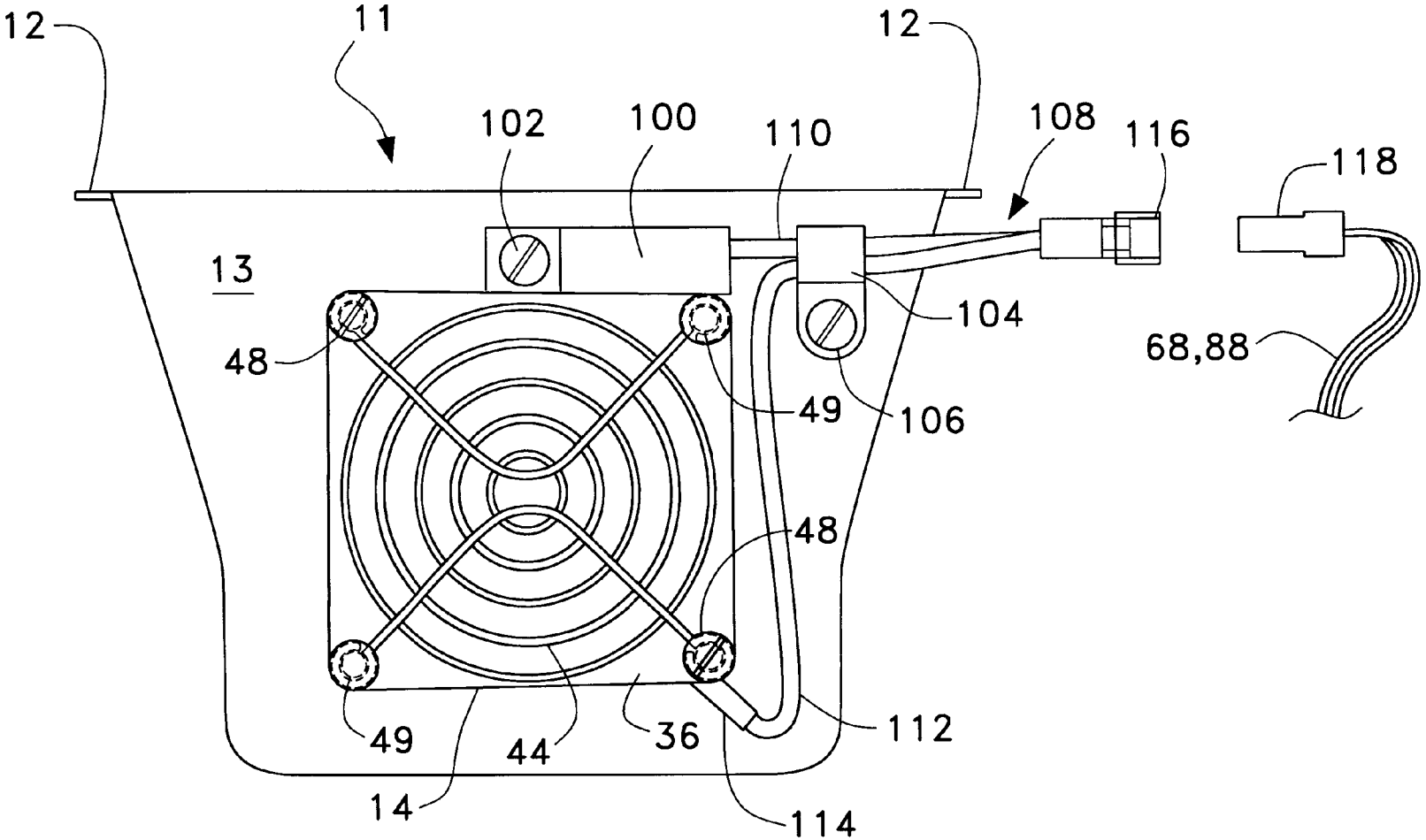
FIG. 7 is a plan view of the fan as mounted on the bracket and showing a motor electrical harness along with a connection to either of the kit electrical harness of FIG. 6A and FIG. 6B.

Referring to FIG. 7, there is shown a plan view of the fan 14 as mounted on horizontal support wall 13 of angle bracket 11, along with the fan motor harness of the preferred embodiment of the invention. Motor wiring harness 100 is fastened to bracket 11 by enclosure bracket mounting screw 102 and cable secure clamp 104 is fastened to bracket 11 by secure clamp bracket mounting screw 106. Fan motor three-wire harness 108 is supported on bracket 11 for strain relief by cable secure clamp 104. The three-wire harness is then split into a two-wire circuit which enters fan motor harness enclosure 100 where they are connected to quick disconnect terminals which connect with the two male terminals of the motor(not shown), and a ground wire 112 which is connected with ground wire motor terminal 114. Three wire motor harness 108 includes a three-wire plug 116 for attachment to kit harness receptacle 118 of kit harness 60 or 80(see FIGS. 6A and 6B) at fan connecting wires 68 or 88, respectively.

The preferred kit, then, has only the fan and motor with the motor wiring harness, the bracket, and the two alternative kit wiring harnesses 60 and 80 to be selected by the installer according to the type of refrigerator and ice-maker wiring harness connectors installed in the refrigerator.

In summary the three-wire connector on the motor harness attaches to the mating three-wire connector on the kit harness. The kit harness has two four-wire connectors and one 3-wire connector. The two four-wire connectors fit between the existing ice maker harness and the existing refrigerator harness. One of the four-wire connectors has a pigtail with three wires leading to the three-wire connector that attaches to the motor harness three-wire connector. The grounding path goes from the refrigerator enclosure wall through its mounting screw to the bracket, from the bracket through the bracket-to-motor screw to the motor, from the motor through the ground wire, and then to the refrigerator ground at the refrigerator four-wire connector.

It is to be understood that the present invention is not limited to the embodiments described above, but encompasses any and all embodiments within the scope of the following claims.

I claim:

1. A kit to accelerate refrigerator ice-maker ice production comprising:

a bracket having a horizontal wall having a grill;

a fan; and a power source for driving said fan;

said bracket being so configured as to mount to a refrigerator wall in the vicinity of an ice-making machine having an exposed, horizontally disposed ice freezing tray;

said fan being vertically oriented so as to move cold air downward and being mounted on said bracket so as to align with said grill so as to allow cold air to move through said grill;

said bracket being so located relative to said ice-making machine that cold air from said fan is directed downwardly directly toward said exposed ice freezing tray; whereby water introduced into said ice freezing tray is exposed to the direct flow of downward directed cold air from said fan.

2. The kit of claim 1, wherein said fan is located in close proximity to said ice freezing tray while remaining spaced therefrom to allow for the rotation of the fingers for removal of ice cubes from said ice freezing tray.

3. The kit of claim 2, wherein said bracket is and angle bracket having a vertical wall extending downward from said horizontal wall, said vertical wall being so adapted as to mount on a refrigerator end wall, said horizontal wall having an upper surface.

4. The kit of claim 3, wherein said fan is mounted on said horizontal wall upper surface so as to align with said grill.

5. The kit of claim 4, wherein said fan includes a horizontally disposed impeller, and an electric motor for driving said impeller, a vertically oriented cylindrical duct, the height of said duct being defined by upper and lower mounting plates, said impeller and said electric motor being mounted for rotation in said vertically oriented cylindrical duct.

6. The kit of claim 5, wherein said horizontal plate of said bracket define fastener holes disposed around the periphery of said grill and said lower mounting plate of said fan has fastener receivers and is mounted to said bracket by means of fasteners aligned with said fastener holes and secured in said fastener receivers.

7. The kit of claim 6, further comprising a safety cage mounted on said upper mounting plate so as to cover said vertical duct and said fan impeller.

8. The kit of claim 7, further comprising a motor wiring harness having a connector, two electrical wires leading from said connector to said motor, thereby forming and electrical circuit with said motor, and a ground wire leading from said connector to a motor ground.

9. The kit of claim 8, further comprising a kit wiring harness having a first kit connector for connection with said motor wiring harness connector, a second kit connector for connection with an ice-maker electrical connector, and a third kit connector for connection with a refrigerator power source connector, whereby electrical power from said refrigerator is provided to said motor electrical harness and said ice-maker.

10. The kit of claim 9, wherein said third kit connector comprises a pigtail, said kit wiring harness further comprising a three wire lead between said pigtail and said first kit connector for supplying electrical power to said motor, and a multiple wire lead between said second connector and said third connector for supplying electrical power to said ice-maker.

11. The kit of claim 10, wherein said second kit connector and said third kit connector are locking tab type connectors for engagement with a corresponding locking tab ice-maker connector and a corresponding locking tab refrigerator power source connector.

12. The kit of claim 10, wherein said second kit connector and said third kit connector are squeeze tab type connectors for engagement with a corresponding squeeze tab ice-maker connector and a corresponding squeeze tab refrigerator power source connector.

13. The kit of claim 5, further comprising a kit end housing having an end wall and four peripheral walls normal thereto configured for connection with the drive of a modular type ice-maker.

14. The kit of claim 13, further comprising a positioning plate located within said kit end housing, spaced from and parallel to said end wall by spacer fasteners.

15. The kit of claim 14, further comprising two electrical probes mounted on said positioning plate and so positioned as to enter and make electrical contact with respective "t"

and "s" test ports of said ice-maker drive when said kit end housing is mounted on said drive.

16. The kit of claim 15, wherein said kit end housing defines a wiring bore in one of its said peripheral walls, said kit further comprising a two-wire electrical harness having a plug for electrical connection with said fan motor and connected with said electrical probes so as to supply electrical power from said test ports and said fan motor, said two-wire harness exiting said kit end housing through said wiring bore.

17. The kit of claim 3, wherein said vertical wall defines bracket mounting grooves opening downward and so placed and configured as to engage ice-maker mounting screws attaching said ice-maker to said refrigerator end wall.

18. The kit of claim 17, wherein said vertical wall defines clip mount access squares so placed and configured as to engage ice-maker mounting clips removably attaching said ice-maker to said refrigerator end wall.

* * * * *